US008050614B2

(12) United States Patent
Nuriel et al.

(10) Patent No.: US 8,050,614 B2
(45) Date of Patent: Nov. 1, 2011

(54) HARD IMAGE FORMING APPARATUS AND METHOD HAVING CONTAMINATION REMOVAL

(75) Inventors: Shahar Nuriel, Yesod HaMaala (IL); Wael Salalha, Bet Jan (IL); Doron Avramov, Gedera (IL); Ziv Gilan, Ein-yahav (IL); Marko Richter, Rehovot (IL); Giries Kadis, Jaffa (IL); Sharon Nagler, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 233 days.

(21) Appl. No.: 12/400,729

(22) Filed: Mar. 9, 2009

(65) Prior Publication Data

US 2010/0226702 A1 Sep. 9, 2010

(51) Int. Cl.
*G03G 21/00* (2006.01)

(52) U.S. Cl. ..... 399/347

(58) Field of Classification Search ..... 399/345, 399/347, 71, 123, 349
See application file for complete search history.

(56) References Cited

U.S. PATENT DOCUMENTS

| | | | |
|---|---|---|---|
| 5,179,416 | A | 1/1993 | Ku et al. |
| 5,500,724 | A | 3/1996 | Campbell et al. |
| 7,340,200 | B2 | 3/2008 | Kosuge |
| 7,383,013 | B2 | 6/2008 | Watanabe et al. |
| 7,432,033 | B2 | 10/2008 | Chou et al. |
| 2008/0118286 | A1 | 5/2008 | Yamashita et al. |

FOREIGN PATENT DOCUMENTS

| | | | | |
|---|---|---|---|---|
| JP | 10161495 | A | * | 6/1998 |
| JP | 2004117419 | A | * | 4/2004 |
| WO | WO 2007/050064 | A1 | | 5/2007 |
| WO | WO 2008/133617 | A1 | | 11/2008 |

OTHER PUBLICATIONS

"Surface Chemistry, Fakir Droplets"; Quere, David; Nature Materials, vol. 1, Sep. 2002; pp. 14-15.
"3M Polishing Film"; Technical Datasheet; Jan. 2004; 2 pp.
"Superfinishing"; http://en.wikipedia.org/wiki/superfinishing; Dec. 4, 2008; 1 p.

* cited by examiner

*Primary Examiner* — Robert Beatty

(57) ABSTRACT

Hard image forming apparatuses and methods are described. According to one arrangement, a hard image forming apparatus includes an imaging member comprising a surface, a development system configured to provide a marking agent to the surface of the imaging member to form developed images upon the surface of the imaging member which correspond to latent images formed using the surface of the imaging member, and a transfer system configured to transfer the developed images from the surface of the imaging member to media. The arrangement further includes a contamination removal device configured to remove contamination material from the surface of the imaging member, and a control system configured to control the contamination removal device to contact the surface of the imaging member to remove the contamination material from the surface of the imaging member at a first moment in time and to space the contamination removal device from the surface of the imaging member at a second moment in time where the contamination removal device does not remove the contamination material from the surface of the imaging member.

13 Claims, 2 Drawing Sheets

HARD IMAGE FORMING APPARATUS AND METHOD HAVING CONTAMINATION REMOVAL

FIELD OF THE DISCLOSURE

Aspects of the disclosure relate to hard image forming apparatuses and methods.

BACKGROUND

Imaging devices capable of printing images upon paper and other media are becoming increasingly popular and used in many applications including color reproduction. For example, laser printers, ink jet printers, and digital printing presses are but a few examples of imaging devices in wide use today for black and white or color imaging. Digital printing presses are relatively new compared with other printing technologies and may be used in place of other printing press arrangements, such as analog printing presses. In one imaging example utilizing a press, a plurality of copies of the same image may be reproduced in relatively high volumes (e.g., printing business cards, catalogs, publications, etc.). Some analog systems may have relatively long set up times for different jobs to be imaged. In these implementations, it may not be desired to use analog systems if a relatively small number of copies of the job are to be reproduced.

An imaging member (e.g., photoconductor) of an imaging device may be susceptible to contamination during imaging operations. This contamination may lead to changes in electrical and mechanical properties of the imaging member. For example, the contamination may cause increased lateral conductivity upon the surface of the imaging member resulting in non-uniform optical density (OD) and unacceptable print quality.

DETAILED DESCRIPTION

At least some aspects of the disclosure pertain to hard image forming apparatuses and hard imaging methods. Hard imaging refers to formation of images upon output media (e.g., printing or copying upon paper in illustrative examples). Some more specific embodiments relate to methods and apparatus for implementing hard imaging of color images upon paper. As discussed further below, some aspects of the disclosure relate to printing using a digital printing press, for example, configured to perform relatively high volume color printing upon media in one embodiment. Some aspects of the disclosure are discussed with respect to an example liquid electrophotography (LEP) imaging process which uses a liquid marking agent although other imaging configurations for forming hard images upon media are possible. At least some aspects of the disclosure are directed towards reducing contamination upon a photoconductive imaging member of the hard image forming apparatus which may result from imaging operations to form hard copy images.

Figure 1:
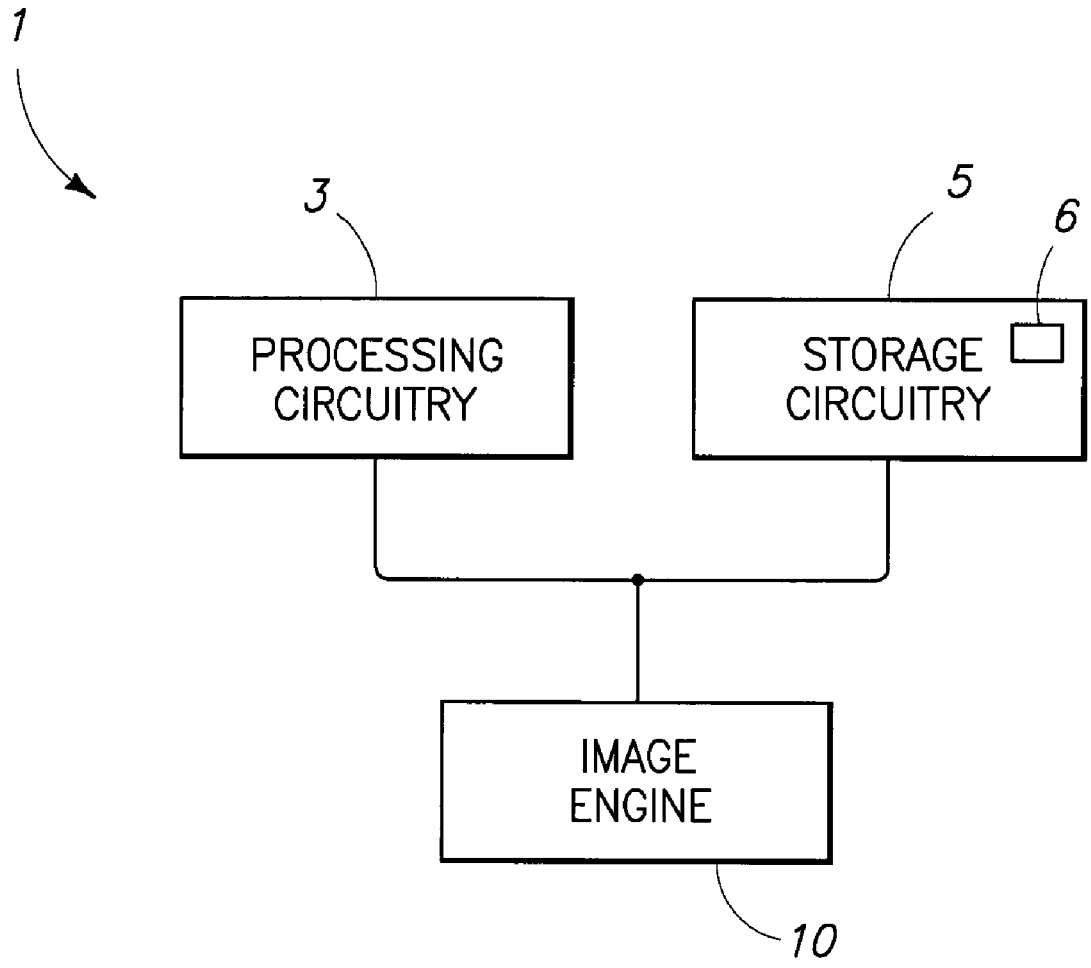
FIG. 1 is a functional block diagram of a hard image forming apparatus according to one embodiment.

Referring to FIG. 1, an illustrative representation of a hard image forming apparatus 1 is depicted. In one embodiment, the hard image forming apparatus 1 may be configured as a digital hard image forming apparatus configured to access digital image data to form hard copy images upon media, such as paper, labels, transparencies, etc. For example, the hard image forming apparatus 1 may be configured as a color digital press, such as an HP Indigo color digital printing press available from the Hewlett-Packard Company in one example arrangement, and which may be suitable for commercial, high-quality, high-volume applications. In one digital printing press embodiment, the hard image forming apparatus 1 prints a plurality of impressions (e.g., thousands of impressions for a single print job and corresponding to respective printed sheets of media) upon a continuous web of media. Hard image forming apparatus 1 may print upon individual paper sheet media in another embodiment. Other configurations of hard image forming apparatus 1 are possible in other embodiments.

Hard image forming apparatus 1 includes processing circuitry 3, storage circuitry 5, and an image engine 10 in the depicted example configuration. Other configurations of hard image forming apparatus 1 are possible in other embodiments including more, less and/or alternative components.

In one embodiment, processing circuitry 3 is arranged to process data (e.g., access and process digital image data corresponding to a color image to be hard imaged upon media), control data access and storage, issue commands, monitor imaging operations and control imaging operations of hard image forming apparatus 1. In one embodiment, processing circuitry 3 is configured as a control system to control operations described herein to remove contamination material from an imaging member described below.

Processing circuitry 3 may comprise circuitry configured to implement desired programming provided by appropriate media in at least one embodiment. For example, the processing circuitry 3 may be implemented as one or more of a processor and/or other structure configured to execute executable instructions including, for example, software and/or firmware instructions, and/or hardware circuitry. Example embodiments of processing circuitry 3 include hardware logic, PGA, FPGA, ASIC, state machines, and/or other structures alone or in combination with a processor. These examples of processing circuitry 3 are for illustration and other configurations are possible.

The storage circuitry 5 is configured to store programming such as executable code or instructions (e.g., software and/or firmware), electronic data (e.g., image data), databases, look-up tables, or other digital information and may include processor-usable media. Processor-usable media includes any computer program product or article of manufacture 6 which can contain, store, or maintain programming, data and/or digital information for use by or in connection with an instruction execution system including processing circuitry 3 in the example embodiment. For example, processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 5 described above and configured to control appropriate processing circuitry 3. For example, programming may be provided via appropriate media including for example articles of manufacture 6.

Image engine 10 is configured to implement liquid electrophotography (LEP) imaging operations including forming latent images, developing the latent images, and transferring the developed images to media in one possible embodiment. Other imaging techniques or methods may be used to form hard images in other embodiments.

In the embodiment discussed in further detail below, image engine 10 is configured to implement imaging operations to form latent images responsive to image data and to develop the latent images using marking agents of a plurality of different colors. In one illustrative embodiment, the marking agents may be provided in liquid form (e.g., charged liquid inks) by respective reservoirs or tanks and which individually include a liquid carrier (e.g., Isopar L™ imaging oil available from ExxonMobil Corporation) and one of a plurality of different colors of electrically charged ink particles (e.g., respective colors of CMYK in one example). The electrically charged ink particles are directed to the latent images to develop the images and the liquid carrier may be evaporated in one embodiment. Other marking agents may be used in other embodiments and other configurations of image engine 10 are possible.

Figure 2:
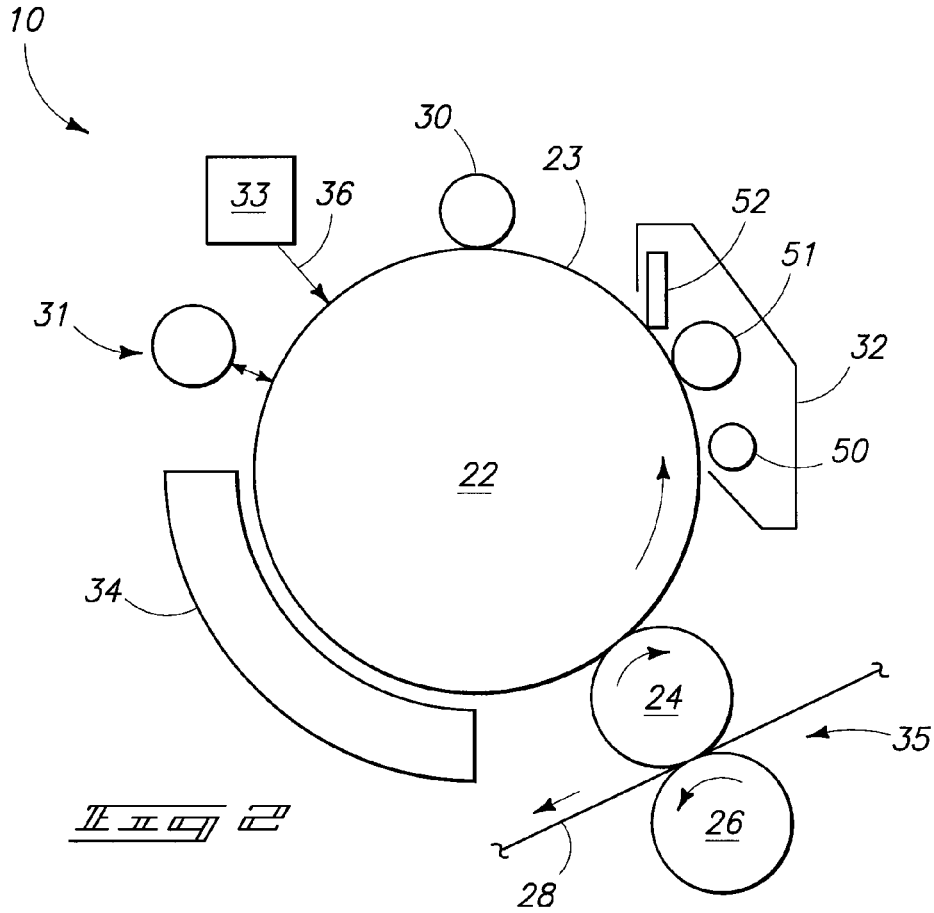
FIG. 2 is an illustrative representation of an image engine according to one embodiment.

Referring to FIG. 2, additional details of an example image engine 10 configured to implement printing are shown according to one embodiment. In the illustrated example configuration, image engine 10 comprises an imaging member 22, intermediate transfer drum 24 and impression drum 26. Other configurations of image engine 10 are possible.

Imaging member 22 comprises a photoconductive imaging member (e.g., drum or belt) which may include an outer layer of organic photoconductor materials deposited upon an underlying conductor in one embodiment. The imaging member 22 depicted in FIG. 2 is a drum arranged to rotate in a counterclockwise process direction during imaging operations in one embodiment. In the depicted embodiment, a plurality of additional imaging systems are positioned adjacent to imaging member 22. The additional imaging systems in the depicted example embodiment include a charging system 30, a contamination removal system 31, a cleaning system 32, a writing system 33, a development system 34 and a transfer system 35. Other embodiments are possible including more, less and/or additional systems.

Charging system 30 is positioned adjacent to the imaging member 10 to provide an electrical charge of a common polarity to a photoconductive surface 23 of imaging member 22. Charge system 30 may be embodied as a roller as shown in the depicted embodiment. Other configurations such as a corona are possible.

In the described embodiment, writing system 33 generates a laser beam 36 to selectively discharge portions of the charged surface 23 of imaging member 22 to form latent images. Processing circuitry 3 may provide appropriate image data to control the writing system 33 to form desired latent electrostatic images in one embodiment.

Cleaning system 32 is configured to clean surface 23 of imaging member 22 in one embodiment. During the image transfer process, some of the developed image may not be completely transferred by transfer system 35 to media 28 and which may leave residual materials such as partially fused ink or fused ink, imaging oil, charge directors and other dissolved materials on the photoconductor surface. Cleaning system 32 is used to remove these residuals from the photoconductor surface 23 in the depicted example embodiment. One embodiment of cleaning system 32 includes a wetting roller 50 which raises imaging oil and residual materials on the photoconductor surface 23, then a sponge roller 51 subsequently rubs the surface 23 and removes the imaging oil and residual materials. Finally, a deformable blade 52 is used to scrape the photoconductor surface 23 and remove the remaining imaging oil and residual material.

Development system 34 may contain a plurality of developers (not shown) configured to provide marking agents to the surface 23 of imaging member 22 to form developed images which correspond to the latent images of the imaging member 22. In some example color implementations, the marking agents may be provided simultaneously or in different separations. In one embodiment, the ink particles of the marking agents are charged to approximately the same electrical polarity as the charge provided by charging system 30 to the surface 23 of imaging member 22. Accordingly, the ink particles are attracted to the discharged portions (i.e., latent images) upon the surface 23 of imaging member 22 during development of the latent images. Following development using the marking agent(s), developed images are transferred from imaging member 22 to intermediate transfer drum 24 of transfer system 35 and to media 28.

In the illustrated embodiment, media 28 traveling along a paper path of image engine 10 passes between intermediate transfer drum 24 and impression drum 26 also of the transfer system 35. The intermediate transfer drum 24 transfers developed images from imaging member 22 to media 28 in the depicted embodiment. According to the illustrated arrangement of image engine 10, the media 28 may receive a plurality of colors of different separations on a single pass through drums 24, 26. In other embodiments, different color separations may be separately applied to media 28 by transfer system 35 during separate passes of media 28 through the transfer system 35. Alternative configurations of image engine 10 are possible in other embodiments.

In addition to the above-described residual materials removed by cleaning system 32, the surface 23 of the imaging member 22 may be subject to additional contamination during imaging operations. For example, in liquid electrophotography operations, the surface 23 may be contaminated with a molecular chemical layer of contamination material originating from one or more of the ink, charge directors, imaging oil (Isobar L with additives), released materials especially salts from the charge rollers of the Binary Ink Developers (BIDs) (not shown) of development system 34, or ionized gas from charging system 30.

In one example, the contamination material may include Lithium salts, xylene, and/or other molecular materials released from ink or rollers and which adhere to surface 23. The accumulation of contamination material upon surface 23 may cause increased lateral conductivity on the surface 23 of imaging member 22 which may result in non-uniform optical density and degradation of print quality.

Contamination removal system 31 is configured to remove a molecular chemical layer of the contamination material from the surface 23 of imaging member 22. In one embodiment, contamination removal system 31 is configured to remove a molecular chemical layer of contamination material from the surface 23 of imaging member 22 before the amount of contamination material accumulated upon surface 23 degrades print quality. In one embodiment described below, contamination removal system 31 performs cleaning operations upon the surface 23 of the imaging member 22 at moments in time when image engine 10 is not forming hard images.

Figure 3:
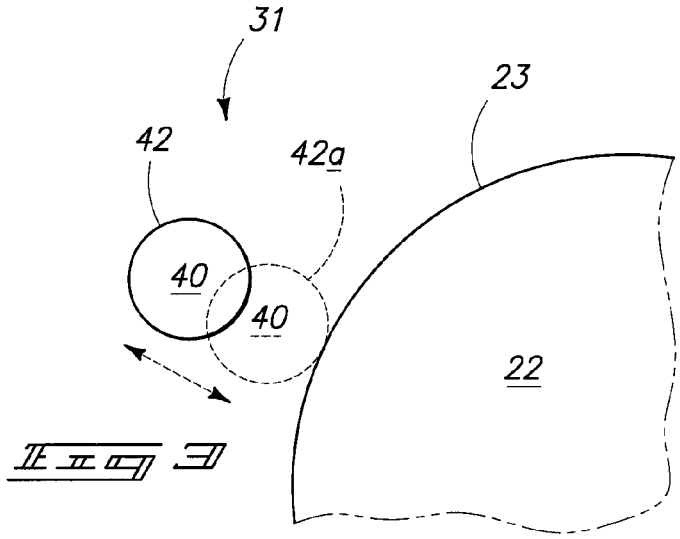
FIG. 3 is an illustrative representation of a contamination removal system according to one embodiment.

Referring to FIG. 3, additional details of contamination removal system 31 configured according to one embodiment are shown. The contamination removal system 31 comprises a contamination removal device 40 in the form of a roller in the depicted embodiment. The contamination removal device 40 may be moved between a plurality of positions 42, 42*a* relative to the surface 23 of imaging member 23 in one embodiment to provide intermittent, non-continuous cleaning of surface 23. The contamination removal device 40 is spaced from the surface 23 of the imaging member 22 in the position 42 and the contamination removal device 40 contacts the surface 23 of the imaging member 22 in the position 42*a* in the described embodiment.

Contamination removal device 40 may be moved between the different positions 42, 42*a* at different moments in time during different operations of image engine 10. In one embodiment, contamination removal device 40 is provided in the spaced position 42 during imaging operations of image engine 10 to process and form hard images of an imaging job. For example, contamination removal device 40 is provided in the spaced position 42 during charging of surface 33, writing upon surface 23, developing and transferring of hard images to media 28. The contamination removal device 42 is provided in cleaning position 42*a* during cleaning operations of image engine 10 to remove contamination material from surface 23 of imaging member 22.

The contamination removal device 40 may be moved between the different positions 42, 42*a* at different moments in time as a result of control by processing circuitry 3 configured as a control system in one embodiment. For example, the control system may control an actuator (not shown) of the contamination removal system 31 to move the contamination removal device 40 between different positions 42, 42*a*.

In one operational example discussed above, the control system provides contamination removal device 40 in the spaced position 42 during imaging operations while latent images are being developed upon imaging member 22 and the developed images are transferred to media 28 via transfer system 35 to form the hard images upon media 28. Following the completion of the imaging of an imaging job (e.g., thousands of impressions for the job) and prior to the initiation of the imaging of an immediately subsequent job, the control system may move the contamination removal device 40 from the spaced position 42 to the contacting position 42*a* to implement cleaning operations to remove the molecular chemical layer of contamination material from the surface 23 of imaging member 22. In another embodiment, cleaning may be implemented following a specified number of impressions. Thereafter, following a desired amount of cleaning of the surface 23, the control system may return the contamination removal device 40 to position 42 prior to the initiation of the immediately subsequent imaging job. The contamination removal device 40 does not remove the contamination material from surface 23 of imaging member 22 while positioned in position 42 in one embodiment. Other control schemes may be used to control the positioning of contamination removal device 40 in other embodiments.

In the depicted embodiment, the contamination removal system 31 is located at a position downstream from the charging system 30 with respect to a process direction (e.g., direction of rotation of imaging drum 22 in the described example) and upstream of the cleaning system 32 with respect to the process direction. In one embodiment, cleaning system 32 is positioned downstream of the contamination removal device 31 in the process direction to remove any particles of the contamination material upon surface 23 resulting from the removal of the molecular chemical layer of contamination material which was adhered to surface 23 of imaging member 22 and prior to such contamination particles reaching the charging system 30. Accordingly, in one embodiment, the contamination removal system 31 removes contamination material from a portion of the surface 23 of the imaging member 22 which has moved past charging system 30 and before the portion of the surface 23 reaches the cleaning system 32 where particles of contamination material may be removed. The particles of the contamination material upon surface 23 may plug the contamination removal device 40. Accordingly, removal of the particles from the surface 23 by the cleaning system 32 may extend the life of the contamination removal device 40 in one embodiment. In another embodiment, contamination removal device 40 may be located upstream of the charging system 30 and the charging system 30 may be disabled to not charge imaging member 22 during moments in time when the contamination removal device 40 is removing contamination material from surface 23.

In one embodiment, the contamination removal device 40 comprises an abrasive member configured to abrade a layer of the contamination material adhered to the surface 23 of imaging member 22 when the contamination removal device 40 is provided in position 42*a* to contact surface 23 while reducing or avoiding abrading material of the imaging member 22 itself. The outer photoconductive layer of the imaging member 22 comprising the surface 23 is relatively thin (e.g., <20 microns) in one configuration. Accordingly, it is desired in one embodiment to reduce or avoid removing material of the imaging member 22 while the contamination material is being removed by device 40.

In one embodiment, the contamination removal device 40 is configured to implement superfinishing to remove the contamination material (e.g., molecular layer of contamination material adhered to surface 23) while reducing or avoiding removal of material of the imaging member 22 compared with other techniques such as typical polishing. In one embodiment, the contamination removal device 40 includes the abrasive member in the form of an abrasive pad mounted on neoprene foam backing plated on a metal core to contact and remove contamination material from surface 23. In one arrangement, the abrasive pad is a 291X polishing pad available from 3M™ and which includes aluminum oxide particles of less than 1 micron coated on a flocked fibrous 3 mil polyester backing. The contamination removal device 40 may be driven in one embodiment to rotate at a linear velocity of 0.05 m/s to 0.1 m/s in a direction opposite to the direction of rotation of the imaging member 22 which may move at a linear velocity of 1 m/s to 2 m/s in one example. The contamination removal device 40 implemented as a roller in one embodiment has a diameter of 0.04 m and a pressure between 0.025 MPa and 0.05 MPa is provided between the contamination removal device 40 and the imaging member 22 having a diameter of approximately 0.3-0.4 m in one implementation.

This described example configuration of contamination removal device 40 implementing superfinishing provides a relatively small (e.g., nanometer scale) surface roughness on the surface 23 (e.g., approximately 12 nm) during removal of the contamination material (e.g., compared with a surface roughness of approximately 4 nm prior to superfinishing). This surface roughness changes the surface energy of the imaging member 22 due to a Fakir-effect produced by the roughening of surface 23 by contamination removal device 40. In particular, the roughened surface has an increased surface area compared with a non-roughened surface which provides increased hydrophobicity resulting in improved transfer of developed images from surface 23 to intermediate transfer drum 24 in at least one embodiment. In addition, the cleaning and removal of the molecular contamination layer by contamination removal system 31 provides the imaging member 22 having reduced surface energy values in one embodiment (e.g., ~47 dyne/cm after cleaning by system 31 compared with ~55 dyne/cm before cleaning by system 31). In one embodiment, the surface energy values achievable by cleaning by system 31 are less than the surface energy values of a new imaging member 22 (e.g., ~50 dyne/cm) due to the Fakir effect.

As mentioned above, the outer photoconductive layer of the imaging member 22 comprising the surface 23 is relatively thin (e.g., <20 microns) in one configuration. In one embodiment mentioned above, contamination removal system 31 is configured to remove contamination material from surface 23 while reducing or avoiding removal of material of the imaging member 22 during the removal of the contamination material to extend the life of the imaging member 22. As discussed above in one embodiment, the contamination removal system 31 is configured to remove the contamination material on non-continuous, intermittent basis which provides reduced wear of the imaging member 22 and contamination removal device 40 compared with an arrangement configured to continuously remove contamination material from surface 23.

In one embodiment, the contamination removal device 40 is provided in position 42*a* (FIG. 3) to remove contamination material only during a null cycle (e.g., a moment in time after one imaging job has been completely imaged by the apparatus 1 and prior to initiation of the imaging of an immediately subsequent imaging job) and is otherwise spaced from the surface 23 at non-cleaning position 42 (FIG. 3) at other moments in time such as during imaging of jobs. In some arrangements, plural different imaging jobs may be imaged in succession without cleaning by the contamination removal system 31 there between.

Accordingly, in one embodiment, the contamination removal device 40 is configured to remove a layer of contaminant material which has adhered to the surface 23 of the imaging member 22 and resulting from the formation of the developed images using the liquid marking agent.

In one example, cleaning may be implemented after formation of a predetermined number of images (e.g., impressions). In one example, the amount of contamination material upon surface 23 of imaging member 22 may be unacceptable after 10,000 impressions and cleaning may be initiated at an appropriate time (e.g., during a null cycle referred to above) after imaging of 6,000 impressions to insure that the removal of the contamination material is implemented prior to the imaging of 10,000 impressions. In example embodiments, it is desired to implement removal of the contamination material from surface 23 of imaging member 22 before the contamination material has a thickness of 10 nanometers.

In one embodiment, the contamination removal system 31 may include a sensor (not shown) configured to monitor imaging operations of apparatus 1 to determine an appropriate time to implement removal of contamination material from surface 23 of imaging member 22. For example, the sensor may monitor hard images upon media 28 which were formed by apparatus 1 to determine when to initiate cleaning operations. In one more specific example, the sensor may comprise a densitometer configured to monitor optical density of the hard images upon media 28 to determine if cleaning should be implemented (e.g., unacceptable optical density of hard images upon media 28 is detected).

In one embodiment, the duration of cleaning implemented by contamination removal device 40 provided in cleaning position 42*a* during a given cleaning cycle (i.e., between imaging jobs) may be determined by the number of impressions since the previous cleaning cycle. In a more specific example embodiment, the contamination removal device 40 is provided in position 42*a* to remove contamination material for a period of 1 minute for every 10,000 impressions made since the previous cleaning cycle. In one embodiment, the durations of cleaning cycles and/or number of cleaning cycles performed by system 31 may be varied to provide an average cleaning of 1 minute for every 10,000 impressions. Additional or less cleaning by system 31 may be provided in other embodiments.

Some embodiments of the disclosure provide removal of contaminant material from an imaging member of hard image forming apparatus 1 on an intermittent, non-continuous basis which may improve longevity of the imaging member compared with arrangements which continuously clean the imaging member. More specifically, these embodiments of the disclosure may abrade portions of the imaging member at a slower rate compared with continuous contamination removal procedures which may negatively impact electrical and mechanical properties of the imaging member and result in degraded print quality. Furthermore, continuous removal of contamination material may shorten the life of the contamination removal apparatus compared with intermittent arrangements according to some aspects of the disclosure. In addition, the intermittent abrasive cleaning aspects described herein according to one embodiment of the disclosure avoid or reduce problems associated with chemically cleaning the imaging member (e.g., cracking of the photoconductor).

The protection sought is not to be limited to the disclosed embodiments, which are given by way of example only, but instead is to be limited only by the scope of the appended claims.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

The invention claimed is:

1. A hard image forming apparatus comprising:

an imaging member comprising a surface;

a development system configured to provide a marking agent to the surface of the imaging member to form developed images upon the surface of the imaging member which correspond to latent images formed using the surface of the imaging member;

a transfer system configured to transfer the developed images from the surface of the imaging member to media;

a charging system;

a cleaning system;

a contamination removal device configured to remove contamination material from the surface of the imaging member; and a control system configured to control the contamination removal device to contact the surface of the imaging member to remove the contamination material from the surface of the imaging member at a first moment in time and to space the contamination removal device from the surface of the imaging member at a second moment in time where the contamination removal device does not remove the contamination material from the surface of the imaging member, wherein the contamination removal device is positioned adjacent to the surface of the imaging member at a position between the charging system and the cleaning system with respect to a process direction of the surface of the imaging member.

2. The apparatus of claim 1 wherein the control system is configured to space the contamination removal device from the surface of the imaging member during the formation of the developed images using the development system at the second moment in time.

3. The apparatus of claim 1 wherein the control system is configured to control the contamination removal device to contact the surface of the imaging member after completion of one imaging job and before initiation of another imaging job which is immediately subsequent to the one imaging job.

4. The apparatus of claim 1 wherein the development system is configured to provide the marking agent comprising a liquid marking agent which comprises a plurality of ink particles within a liquid carrier to the surface of the imaging member.

5. The apparatus of claim 4 wherein the contamination removal device is configured to remove the contaminant material resulting from the formation of the developed images using the liquid marking agent and adhered to the surface of the imaging member.

6. The apparatus of claim 1 wherein the contamination removal device comprises an abrasive member configured to abrade the contamination material from the surface of the imaging member.

7. The apparatus of claim 1 wherein the contamination removal device is configured to implement superfinishing to remove the contamination material.

8. The apparatus of claim 1 further comprising:

the charging system configured to provide an electrical charge to the surface of the imaging member;

a writing system configured to selectively discharge portions of the surface of the imaging member to form the latent images; and the cleaning system configured to clean the surface of the imaging member.

9. A hard image forming apparatus comprising:

an imaging member comprising a surface and configured to move in a process direction;

a charging system adjacent to the surface of the imaging member and configured to provide an electrical charge to the surface of the imaging member;

a writing system adjacent to the surface of the imaging member and configured to form latent images using the surface of the imaging member;

a development system adjacent to the surface of the imaging member and configured to provide a marking agent to the surface of the imaging member to form developed images upon the surface of the imaging member which correspond to the latent images;

a transfer system adjacent to the surface of the imaging member and configured to transfer the developed images from the surface of the imaging member to media;

a contamination removal device adjacent to the surface of the imaging member and configured to remove contamination material from the surface of the imaging member which results from imaging operations of the hard image forming apparatus, wherein the removal of the contamination material by the contamination removal device generates a plurality of contamination particles upon the surface of the imaging member; and a cleaning system adjacent to the surface of the imaging member and configured to remove the contamination particles from the surface of the imaging member, wherein the contamination removal device is positioned adjacent to the surface of the imaging member at a position between the charging system and the cleaning system with respect to the process direction of the surface of the imaging member.

10. The apparatus of claim 9 wherein the cleaning system is positioned downstream of the contamination removal device in the process direction.

11. A hard imaging method comprising:

performing a plurality of imaging operations comprising:

charging a surface of an imaging member;

forming a plurality of latent images upon the surface of the imaging member;

developing the latent images using a marking agent, the developing forming a plurality of developed images upon the surface of the imaging member;

transferring the developed images from the surface of the imaging member to media; and cleaning the surface of the imaging member;

removing contamination material from the surface of the imaging member using a contamination removal device in contact with the surface of the imaging member; and spacing the contamination removal device from the surface of the imaging member during at least one of the imaging operations, wherein the removing comprises removing the contamination material from a portion of the imaging member after the imaging member portion has been charged and before the imaging member portion is cleaned, removing contamination material being performed between the charging and the cleaning of the surface of the imaging member.

12. The method of claim 11 wherein the performing comprises performing the imaging operations for a plurality of different imaging jobs and the removing comprises removing only between the performing the imaging operations for different ones of the imaging jobs.

13. The method of claim 11 wherein the spacing comprises spacing during the forming, developing and transferring.

* * * * *